US007954256B2

(12) United States Patent
Colella

(10) Patent No.: US 7,954,256 B2
(45) Date of Patent: Jun. 7, 2011

(54) INTERCHANGEABLE FOOTWEAR SYSTEM AND METHOD

(76) Inventor: Antonio Colella, Thousand Oaks, CA (US)

( * ) Notice: Subject to any disclaimer, the term of this patent is extended or adjusted under 35 U.S.C. 154(b) by 916 days.

(21) Appl. No.: 11/810,867

(22) Filed: Jun. 7, 2007

(65) Prior Publication Data

US 2008/0301978 A1 Dec. 11, 2008

(51) Int. Cl.
*A43B 3/24* (2006.01)

(52) U.S. Cl. ..... 36/15; 36/100; 36/42

(58) Field of Classification Search ..... 36/15, 101, 36/100, 36 R, 36 B, 36 C, 42, 41
See application file for complete search history.

(56) References Cited

U.S. PATENT DOCUMENTS

| | | | | | |
|---|---|---|---|---|---|
| 1,743,543 | A | * | 1/1930 | Gutierrez | 36/42 |
| 2,431,868 | A | * | 12/1947 | Gilmour | 36/42 |
| 2,439,310 | A | * | 4/1948 | Mancuso | 36/42 |
| 2,582,551 | A | * | 1/1952 | Malherbe | 36/42 |
| 2,795,866 | A | | 6/1957 | Perugia | |
| 2,795,867 | A | * | 6/1957 | Zuckerman et al. | 36/42 |
| 2,806,302 | A | * | 9/1957 | Sharpe | 36/36 R |
| 2,943,404 | A | | 7/1960 | Sultan | |
| 3,538,628 | A | * | 11/1970 | Einstein, Jr. | 36/15 |
| 3,581,413 | A | * | 6/1971 | Simonetti | 36/42 |
| 3,754,340 | A | | 8/1973 | Pais | |
| 3,797,136 | A | * | 3/1974 | Soleri | 36/42 |
| 4,214,384 | A | | 7/1980 | Gonzalez | |
| 4,267,649 | A | * | 5/1981 | Smith | 36/101 |
| 4,363,177 | A | | 12/1982 | Boros | |
| 4,610,100 | A | * | 9/1986 | Rhodes | 36/42 |
| 4,805,320 | A | | 2/1989 | Goldenberg et al. | |
| 5,058,290 | A | | 10/1991 | Koehl et al. | |
| 5,079,857 | A | | 1/1992 | Clifton | |
| 5,133,138 | A | | 7/1992 | Durcho | |
| 5,347,730 | A | * | 9/1994 | Rodriguez Colon | 36/76 R |
| 5,519,950 | A | * | 5/1996 | Wang | 36/42 |
| 5,524,365 | A | | 6/1996 | Goldenberg | |
| D378,548 | S | | 3/1997 | Harman, II | |
| 5,675,916 | A | * | 10/1997 | Lewis | 36/36 R |
| 5,953,836 | A | | 9/1999 | Watt et al. | |
| 5,970,630 | A | * | 10/1999 | Gallegos | 36/100 |
| 6,711,835 | B1 | | 3/2004 | Militello | |
| 7,168,184 | B2 | * | 1/2007 | Wallin et al. | 36/15 |
| 7,185,448 | B2 | | 3/2007 | Schupbach | |
| 2001/0052195 | A1 | * | 12/2001 | Blakey | 36/100 |
| 2007/0011909 | A1 | | 1/2007 | Palmeri, III | |

FOREIGN PATENT DOCUMENTS

| | | |
|---|---|---|
| JP | 09075107 | 3/1997 |

* cited by examiner

*Primary Examiner* — Marie Patterson
(74) *Attorney, Agent, or Firm* — Cislo & Thomas, LLP

(57) ABSTRACT

A footwear system (S) and corresponding methods ($M_1$) and ($M_2$) for providing a plethora of footwear fashion options via a plurality of interchangeable components, the interchangeability of which being facilitated by structurally stable quick-coupling and quick-decoupling techniques. The system (S) includes a plurality of interchangeable uppers (100), a plurality of interchangeable heels (200), and a quick-release device (300) for easily and selectively engaging a heel (200) of the plurality of interchangeable heels (200) with an upper (100) of the plurality of interchangeable uppers (100). The quick-release device (300) has a safety feature for providing structural stability.

14 Claims, 4 Drawing Sheets

INTERCHANGEABLE FOOTWEAR SYSTEM AND METHOD

TECHNICAL FIELD

The present invention technically relates to footwear systems and methods. More particularly, the present invention technically relates to footwear systems and methods for providing fashion options. Even more particularly, the present invention technically relates to footwear systems and methods for providing fashion options via interchangeable components.

BACKGROUND ART

The currently existing related art involves several systems and methods for providing footwear fashion options. Some of these related art inventions involve converting a shoe from a high heel mode to a low heel mode. U.S. Patent Application Publication No. 2007/0011909 to Palmeri discloses women's footwear that can be worn as both a high heel (pump) shoe or as a flat heel shoe. The high heel portion comprises a clip for coupling to the heel portion of the shoe upper. The clip is of the type used in belt clips, but without a swiveling feature. U.S. Pat. No. 5,953,836 to Watt et al. discloses a shoe having removable heels for permitting a user to wear a single pair of shoes which can be used in a high-heel mode or a flat mode, wherein the heel has a block extending from its upper, and wherein the block has sides and detents corresponding to the sole hole sides and the corresponding apertures. The block is removably inserted into the sole hole. U.S. Pat. No. 5,079,857 to Clifton discloses a shoe having a detachable heel. The shoe includes a foot receptacle portion having a threaded stem extending downwardly from the foot receptacle portion, a locking pin slot, and shoe heel threadably engageable to the stem and having a locking pin assembly which engages the locking pin slot to secure the heel in a fixed position.

Other related art inventions disclose shoes with only interchangeable or replaceable heel elements. U.S. Pat. No. 7,185,448 to Schupback discloses a shoe which includes a releasably attaching structure which comprises a flanged extension disposed on the heel portion of a shoe upper, the shoe upper heel portion being hinged. The flanged extension is disposed into an orifice at the upper portion of the heel. A triggering mechanism is used to activate a tooth from a locked position to an unlocked position, wherein the tooth retains the flanged extension during use of the heel. U.S. Pat. No. 4,805,320 to Goldenberg et al. discloses an article of footwear which comprises a shoe having a removable and replaceable heel and which uses a latch mechanism for inhibiting unintended separation of the heel from the upper. Although the Goldenberg invention attempts to inhibit unintended separation of the heel from the upper, such separation is not altogether prevented. U.S. Pat. No. 6,711,835 to Militello discloses a shoe which includes at least one replaceable heel having a slot in which a rear portion of a plate may be inserted. A front portion of the plate is attached to the front surface of the heel base, such that the replaceable heel can be slid from the rear portion of the plate.

In addition, U.S. Pat. No. 5,524,365 to Goldenberg discloses a shoe which includes a pin member projecting outwardly from a head portion secured to the sole by a screw extending through a bore and threaded in a nut imbedded in the head portion, with the bore and the screw being preferably at an obtuse angle to the pin member, a heel which includes a preassembled capsule lock secured in a bore, wherein the capsule lock includes a housing formed by a bottom cup being press-fit in a top insert, a washer member disposed against the lower surface of a plate being integrally formed in the cylindrical portion of the top insert by a compression spring, the plate being at an acute angle to the axis of the housing and to the pin member. The head portion terminates in a lower cylindrical portion having an abutment surface which flushly abuts the upper surface of the plate when the lower cylindrical portion is slidably fit in a socket formed in the housing. Alignment ears are also slidably fit within troughs when the head portion is slidably fit within a recess formed in the heel. U.S. Pat. No. 5,133,138 to Durcho discloses a shoe having a block downwardly extending from a lower portion of a sole adjacent the heel and with a magnetic plate facing downwardly from the block, a heel having an upper surface with an upwardly facing recess and a magnetically responsive plate facing upwardly on the lower surface of the recess.

Along with the foregoing related art inventions, U.S. Pat. No. 5,058,290 to Koehl et al. discloses a high heel shoe with a self-seating removable heel portion, wherein a heel portion of the sole has a socket with a forwardly facing open end and a closed rear end, the socket having a side wall forming a continuous dove-tail joint portion. The high heel has an enlarged upper end portion with an inclined upper surface and a dove-tail locking member extending upwardly from the high heel upper end portion inclined surface, the locking member including a pedestal with a dove-tail side wall that corresponds to, and registers with, the socket so that the heel can be attached to the socket into a forward to aft direction, wherein the heel is constantly loaded rearward during use, whereby a seating of the heel upon the socket is insured during use. U.S. Pat. No. 4,363,177 to Boros discloses footwear which comprises a plurality of detachable heels and a plurality of detachable uppers being selectively mounted together. The footwear comprises an attachment structure which includes a threaded stud and a threadably engaging cavity. The footwear also comprises an ant-rotation structure which includes a detent and a complementary recess disposed between the heel and the toe areas. However, the Boros footwear is not quickly engageable or disengageable.

Also, U.S. Pat. No. 4,214,384 to Gonzalez discloses a shoe which has a first coupling element secured on a heel portion and a second coupling element defining a heel and being slidably mounted to the first coupling element. A resilient tab in the second coupling element engages a locking groove formed on the first coupling element and is held in place by a removable wedge. U.S. Pat. No. 3,754,340 to Pais discloses a device for coupling the sole and heel of a shoe which comprises a plate which is secured adjacent the sole and which has a shank extending rearward to engage the heel. The shank has a hook which is adapted to be received in a recess in the heel to retain it in position. U.S. Pat. No. 2,943,404 to Sultan discloses a replaceable heel construction comprising a heel locking structure comprising an upper plate which conforms in shape, size and nail openings to the rear plate of the shank. The plate carries a cam which is mounted within, or on, an upper collar. The upper collar carries a handle member. The lower plate has an off-center opening and a stop member to cooperate with the cam. However, the Sultan locking structure provides for neither quick coupling nor quick decoupling.

Further, U.S. Pat. No. 2,795,866 Perugia discloses a shoe with a replaceable heel having a metal tenon, curved along a circular arc in the direction of its length. The tenon protrudes beyond the seat to which it is fastened by screws, for example. The tenon can have a trapezoidal cross-section and can extend far beyond the front edge of the heel seat. Below the insole, a mortise slide is fastened comprises the same radius of curvature as that of the tenon. U.S. Design Pat. No. D378,548 to Harman II discloses a shoe with a heel, wherein the heel height is adjustable. The heel has two portions, an upper portion and a lower portion, the portions being slidably mounted to one another. When the lower portion is removed, the overall heel height is decreased. Japan Patent Application Publication No. JP 09075107 to Lewis discloses a heel which is used by removing the fixed face of a pad layer for exposing the head of a large bolt, loosening the large bolt for separating a heel from a shoe, inserting the projection of another heel in a small opening of an outsole for the directional determination and the subsequent fixing thereof to the shoe to cover the large bolt, and preventing the rear part of an insole from moving within the shoe.

Common problems experienced in the related art is that mounting structures have an inordinate number of components and do not have the structural stability for accepting the heavy loads, e.g., walking or running, and that they are not quickly-releasable for easy use. The related art heels tend to self-dissemble from the soles and/or uppers during walking or running, thereby creating a dangerous condition for the wearer. Further, many of heels in the related art require some mechanical ability on the part of the wearer and/or at least some tools for their proper fastening to the sole and/or the upper. Thus, a long-felt need is seen to exist for a system and a method for providing a plethora of footwear fashion options via a plurality of interchangeable components, the interchangeability of which being facilitated by an attachment structure which is both structurally stable as well as quick-coupling and quick-decoupling for easy use.

DISCLOSURE OF THE INVENTION

The present invention addresses the foregoing problems in the related art in a system and corresponding methods for providing a plethora of footwear fashion options via a plurality of interchangeable components, the interchangeability of which being facilitated by structurally stable quick-coupling and quick-decoupling techniques for easy use.

The present invention footwear system generally comprises a plurality of interchangeable uppers, a plurality of interchangeable heels, and a quick-release device for selectively engaging a heel of the plurality of interchangeable heels with an upper of the plurality of interchangeable uppers. The present invention method of fabricating a footwear system generally comprises the steps of providing a plurality of interchangeable uppers, providing a plurality of interchangeable heels, and providing a quick-release device for selectively engaging a heel of the plurality of interchangeable heels with an upper of the plurality of interchangeable uppers. The present invention method of varying an appearance of footwear by way of a footwear system generally comprises the steps of (a) providing a footwear system, the system providing step comprising the steps of providing a plurality of interchangeable uppers, providing a plurality of interchangeable heels, and providing a quick-release device for selectively engaging a heel of the plurality of interchangeable heels with an upper of the plurality of interchangeable uppers, (b) selecting a heel from the plurality of interchangeable heels, thereby providing a selected heel, (c) selecting an upper from the plurality of interchangeable uppers thereby providing a selected upper, and (d) using the quick-release device to selectively interchange the selected heel with the selected upper, thereby varying the appearance of the footwear.

Advantages of the present invention include, but are not limited to, providing a plethora of footwear fashion options via a plurality of interchangeable components, facilitating interchangeability of the components by providing structurally stable quick-coupling and quick-decoupling techniques, reducing the pairs of footwear in a collection, thereby providing an economical alternative to footwear options, providing nearly infinite possibilities for expanding a footwear collection, decreasing luggage weight for travel, facilitating color and pattern coordination with an infinite number of garments in a wardrobe, and providing greater structural integrity at a heel/sole interface, thereby preventing personal injury to the wearer. Other features of the present invention are disclosed, or are apparent, in the section entitled "Mode(s) for Carrying-Out the Invention," disclosed, infra.

BRIEF DESCRIPTION OF THE DRAWING(S)

For a better understanding of the present invention, reference is made to the below-referenced accompanying Drawing (s). Reference numbers refer to the same or equivalent parts of the present invention throughout the several figures of the Drawing(s).

MODE(S) FOR CARRYING OUT THE INVENTION

Figure 1:
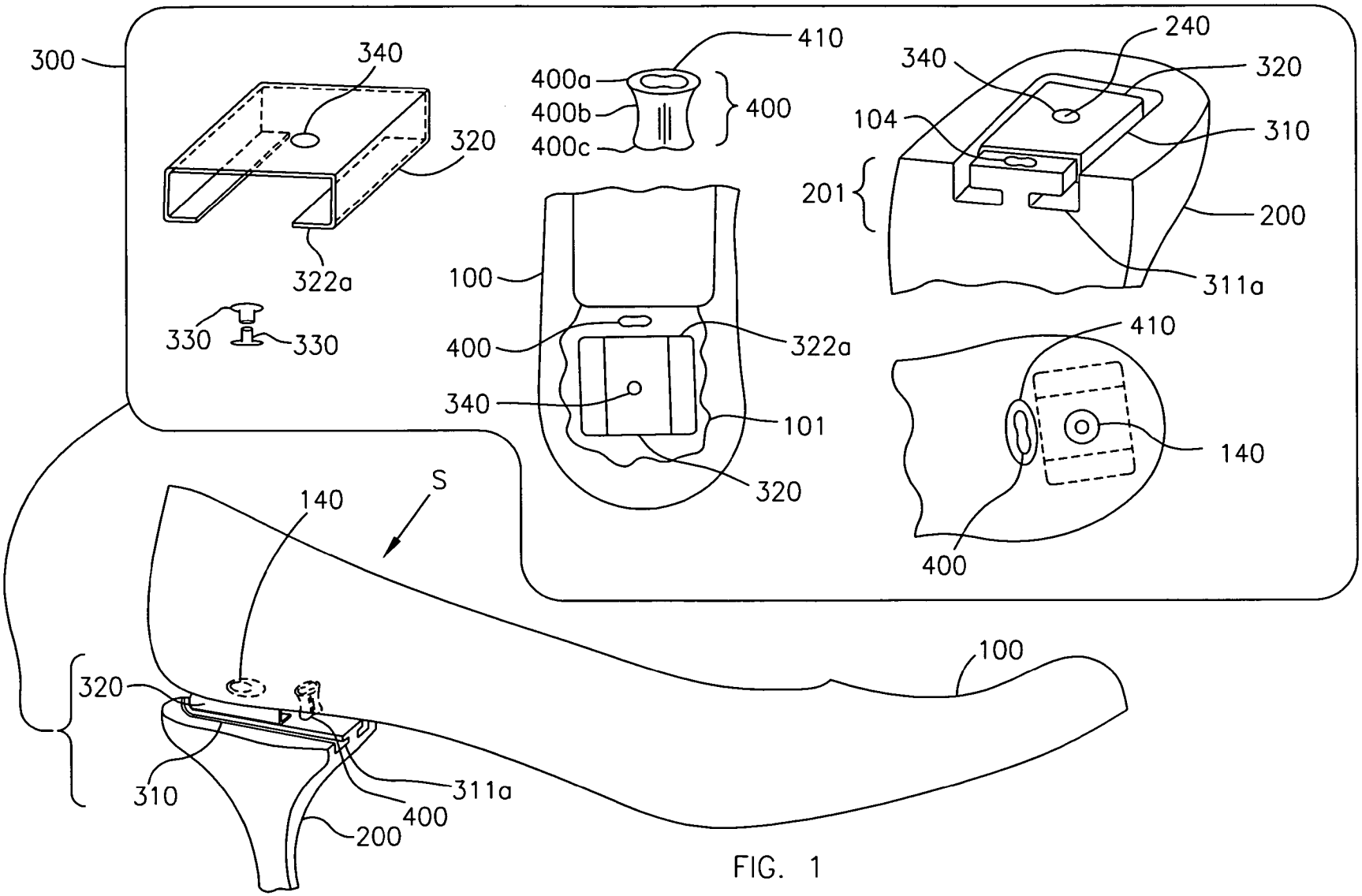
FIG. 1 is a perspective view of an interchangeable footwear system with an exploded view of a quick-release device, in accordance with the present invention.

FIG. 1 illustrates, in a perspective view, an interchangeable footwear system S, with a perspective exploded view of a quick-release device 300, in accordance with the present invention. The present invention footwear system S generally comprises a plurality of interchangeable uppers 100, a plurality of interchangeable heels 200, and a quick-release device 300 for selectively engaging a heel 200 of the plurality of interchangeable heels 200 with an upper 100 of the plurality of interchangeable uppers 100, wherein each upper 100 of the plurality of uppers 100 comprises at least one feature such as a distinct shape, a distinct color, a distinct pattern, a distinct size, and a distinct material, and wherein each heel 200 of the plurality of interchangeable heels 200 comprises at least one feature such as a distinct is shape, a distinct color, a distinct pattern, a distinct height, and a distinct material. The distinct size of each upper facilitates sharing of the system S by members of a household, e.g., siblings, roommates, and the like. The distinct height of each heel facilitates dressing for a multitude of occasions using the system S. The quick-release device 300 is shown in FIG. 1 as having an inward flange configuration.

Figure 2:
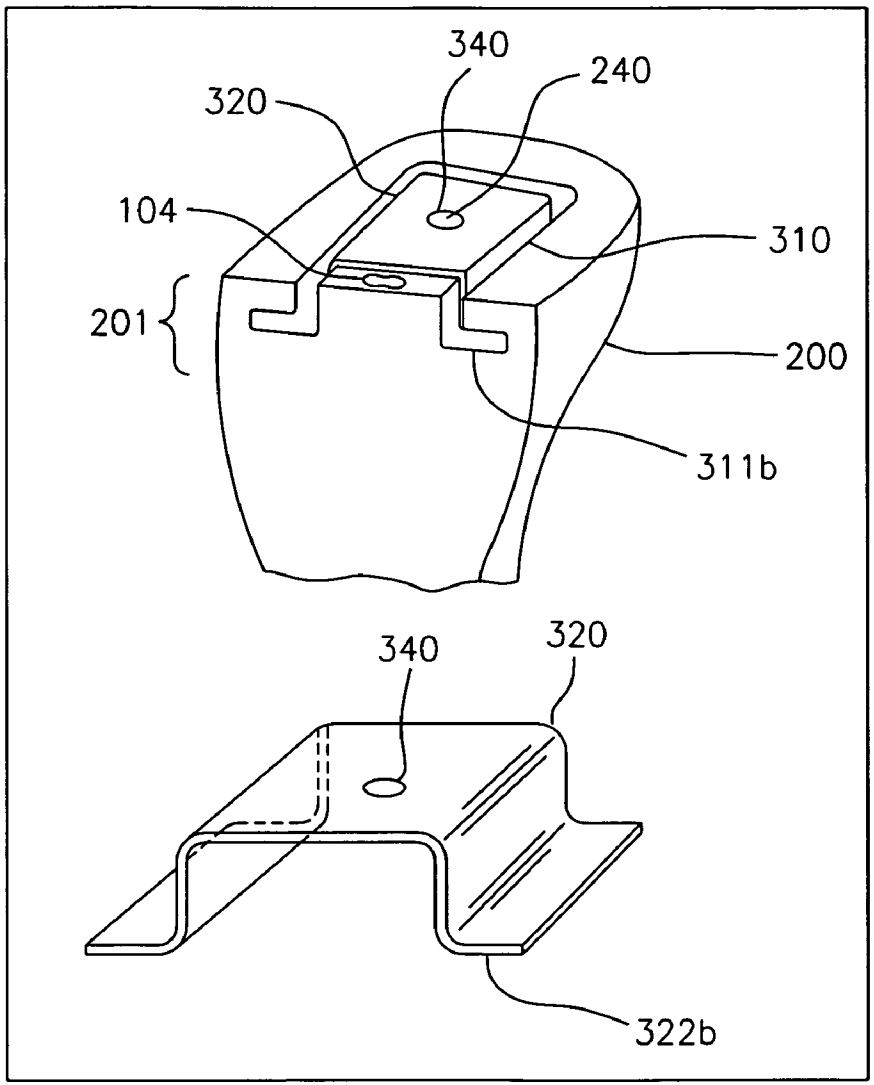
FIG. 2 is an exploded view of a quick-release device of an interchangeable footwear system, in accordance with an alternate embodiment of the present invention.

FIG. 2 illustrates, in a perspective exploded view, a quick-release device 300 of the interchangeable footwear system S, in accordance with an alternate embodiment of the present invention, wherein the quick-release device 300 comprises a safety feature. The quick-release device 300 also comprises a rigid guide 310 and a rigid slide 320, wherein the guide 310 and the slide 320, together, comprise a complementary configuration and a complementary disposition such as (a) the guide 310 being disposed at an upper portion 201 of each heel 200 and the slide 320 being disposed at a heel portion 101 of each upper 100 and (b) the guide 310 being disposed at a heel portion 101 of each upper 100 and the slide 320 being disposed at an upper portion 201 of each heel 200. Further, both the guide 310 and the slide 320 comprise at least one feature such as (a) a complementary inward flange accommodation 311*a* and an inward flange 322*a*, respectively, and (b) a complementary outward flange accommodation 311*b* and an outward flange 322*b*, respectively. The quick-release device 300 is shown in FIG. 2 as having an outward flange configuration. Alternatively, the slide 320 may be integrally formed with, or permanently attached to, the upper 100. The guide 310 comprises a configuration such as a pair of parallel slots and a U-shaped channel, by example only.

Referring to FIGS. 1 and 2, the safety feature further comprises at least one fastener 330, at least one corresponding orifice 240, 340 for locking together the guide 310 and the slide 320, and at least one safety element 400 for providing an interference-fit in a complementary slot 104. The guide 310 and the slide 320 comprise a rigid material such as a metal. The at least one fastener 330 and the at least one orifice, together, comprise a complementary disposition such as (a) the at least one fastener 330 being disposed at an upper portion 201 of each heel 200 and the at least one orifice 240 being disposed at a heel portion 101 of each upper 100 and (b) the at least one orifice 140 being disposed at a heel portion 101 of each upper 100 and the at least one fastener 330 being disposed at an upper portion 201 of each heel 200. The at least one fastener 330 comprises at least one element such as a nail, a pair of complementary rivets, a pair of permanent rivets, a bolt, a pin, and a dowel. The at least one safety element 400 comprises a proximal end 400*a*, an intermediate portion 400*b*, and a distal end 400*c*, the intermediate portion 400*b* comprising a cross-sectional area being less than those of both the proximal and distal ends 400*a*, 400*c*. Both the safety element 400 and the complementary slot 104 comprise at least one cross-sectional configuration such as an oval of Cassini, a cross-section in a plane parallel to an axis of a torus, a two-leaved lemniscate of Bernoulli, and a nephroid, wherein the cross-sectional area of the complementary slot 104 approximates that of the intermediate portion 400*b* for facilitating the interference-fit. The at least one safety element 400 comprises at least one projecting element, such as a flathead nail, a flathead stud, a flathead stud nail, and a stub, and further comprises a reinforcement element 410, such as a rivet ring. The at least one safety element 400 comprises at least one configuration such as a tapered body, a cylindrical body, and a curved body. The reinforcement element 410 comprises a shape complementing that of the safety element 400.

Figure 3:
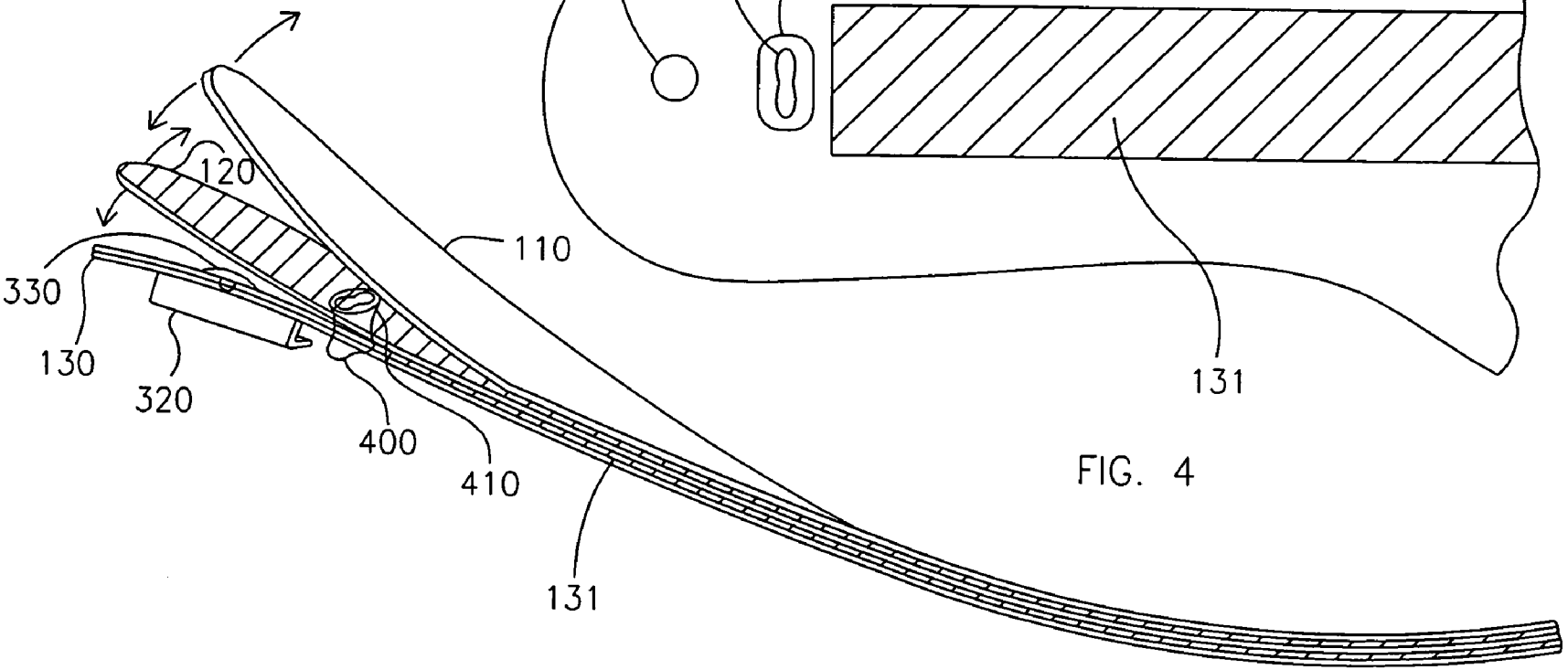
FIG. 3 is a perspective view of an insole-footboard-outsole assembly in a partially dissembled state of an interchangeable footwear system, showing the relationship among the various components, in accordance with the present invention.

FIG. 3 illustrates, in a perspective view, an insole-footboard-outsole assembly in a partially dissembled state of an interchangeable footwear system S, showing the relationship among the various components, in accordance with the present invention. The insole 110 comprises a foam material and is detachable from the footboard 120 at a heel location. In turn, the footboard 120 is detachable from the outsole 130 at a heel location. The outsole 130 comprises a shank 131, wherein the shank 131 comprises a flexible material such as flexible fiberglass. The safety element 400 is disposed through the footboard 120 and the outsole 130, wherein the insole 110 covers the safety element 400, whereby the wearer does not feel the safety element at his/her heel while wearing the footwear. Further, the detachability of the insole 110 and the footboard 120 facilitates interchanging of the plurality of heels 200 by providing easy access to the fastener 330. Preferably, the fastener 330 does not require any tools. Alternatively, the fastener 330 may comprises a pair of permanent rivets, by example only, and may permanently affix the slide 320 to either the upper 100 or the heel 200. In use, the wearer merely peels back the insole 110 and disposes the safety element 400 through the footboard 120 and into the slot 104, hand-tightens the fastener 330 (unless a permanent fastener is used), re-disposes the footboard 120 and the insole 110, and places a foot in the footwear. The insole and the outsole may each comprise a material such as leather and a synthetic material, e.g., vinyl.

Figure 4:
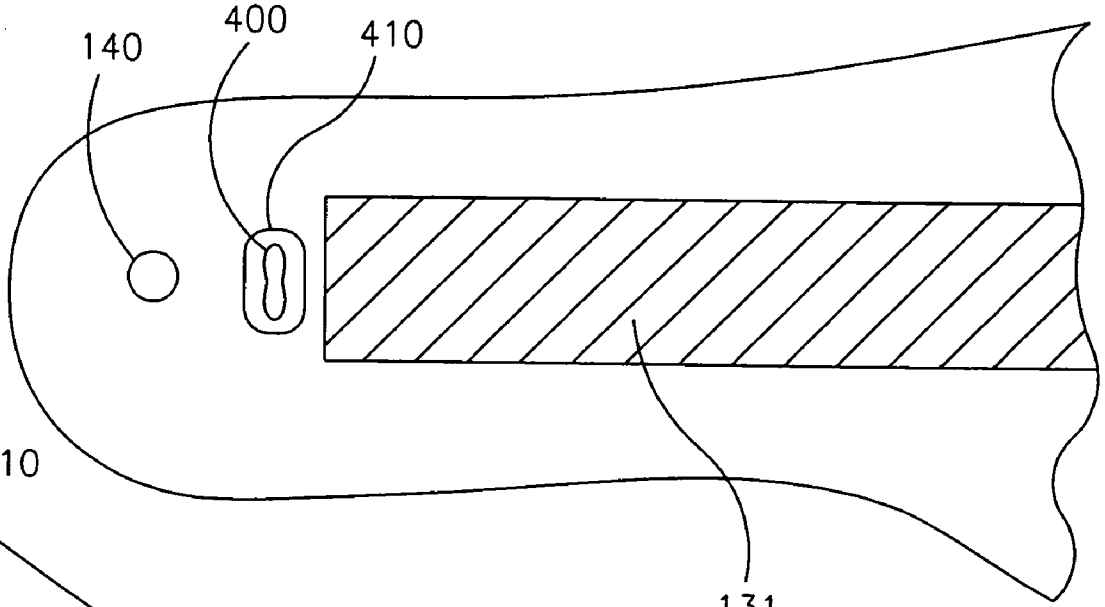
FIG. 4 is a cross-sectional view of an insole-footboard-outsole assembly in an interchangeable footwear system, in accordance with the present invention.

FIG. 4 illustrates, in a cross-sectional view, an insole-footboard-outsole assembly in an interchangeable footwear system S, in accordance with the present invention. As discussed, supra, the outsole 130 comprises a shank 131, wherein the shank 131 comprises a flexible material such as flexible fiberglass. The shank 131 may comprise a rectangular configuration, by example only. The safety element 400 is disposed aft of the shank 131; and the orifice 140 is disposed aft of the safety element 400. The reinforcement element 410 retains and strengthens the safety element 400. The at least one safety element 400 is disposed through both the outsole 130 as well as the footboard 120 and may comprise a mushroom-shaped configuration in relation to the reinforcement element 410 for providing further structural stability.

Figure 5:
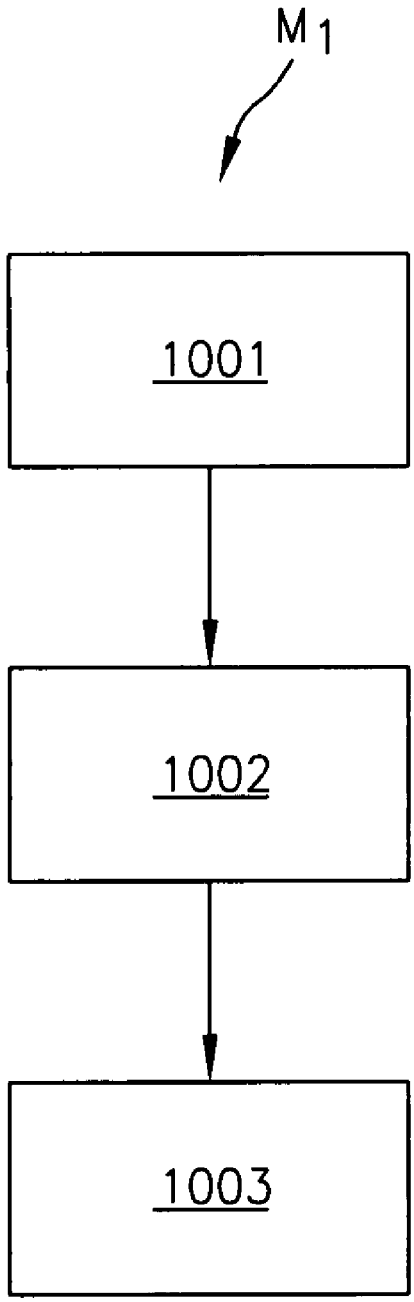
FIG. 5 is a flowchart of a method of fabricating an interchangeable footwear system, in accordance with the present invention.

FIG. 5 illustrates, in a flowchart, a method $M_1$ of fabricating an interchangeable footwear system S, in accordance with the present invention. The present invention method $M_1$ of fabricating an interchangeable footwear system S generally comprises the steps of providing a plurality of interchangeable uppers 100, as indicated by block 1001, providing a plurality of interchangeable heels 200, as indicated by block 1002, and providing a quick-release device 300 for selectively engaging a heel 200 of the plurality of interchangeable heels 200 with an upper 100 of the plurality of interchangeable uppers 100, as indicated by block 1003, wherein the uppers 100 providing step, as indicated by block 1001, comprises providing each upper 100 of the plurality of uppers 100 with at least one feature such as a distinct shape, a distinct color, a distinct pattern, a distinct size, and a distinct material, and wherein the heels 200 providing step, as indicated by block 1002, comprises providing each heel 200 of the plurality of interchangeable heels 200 with at least one feature such as a distinct shape, a distinct color, a distinct pattern, a distinct height, and a distinct material.

Still referring to FIG. 5, the present method $M_1$ comprises further features. The quick-release device 300 providing step, as indicated by block 1003, comprises providing a safety feature. Also, the quick-release device 300 providing step, as indicated by block 1003, comprises providing a rigid guide 310 and providing a rigid slide 320, wherein the guide 310 providing step and the slide 320 providing step, together, comprise providing a complementary configuration and providing a complementary disposition such as (a) the guide 310 being disposed at an upper portion 201 of each heel 200 with the slide 320 being disposed at a heel portion 101 of each upper 100 and (b) the guide 310 being disposed at a heel portion 101 of each upper 100 with the slide 320 being disposed at an upper portion 201 of each heel 200, and wherein both the guide 310 providing step and the slide 320 providing step comprise providing at least one feature such as (a) a complementary inward flange accommodation 311*a* with an inward flange 322*a*, respectively, and (b) a complementary outward flange accommodation 311*b* with an outward flange 322*b*, respectively.

Also with respect to the present method $M_1$, the safety feature providing step comprises providing at least one fastener 330 and at least one complementary orifice 240, 340 for locking together the guide 310 and the slide 320, wherein the at least one fastener 330 providing step comprises providing at least one element such as a nail, a pair of complementary rivets, a pair of permanent rivets, a bolt, a pin, and a dowel. The at least one safety element 400 providing step comprises providing at least one projecting element, such as a flathead nail, a flathead stud, a flathead stud nail, and a stub, and further comprises providing a reinforcement element 410, such as a rivet ring. The at least one safety element 400 providing step comprises providing at least one configuration such as a tapered body, a cylindrical body, and a curved body. The reinforcement element 410 providing step comprises providing a shape which complements that of the safety element 400. The safety element 400 providing step comprises providing a proximal end 400*a*, an intermediate portion 400*b*, and a distal end 400*c*, the intermediate portion 400*b* comprising a cross-sectional area being less than those of both the proximal and distal ends 400*a*, 400*b*. The safety element 400 providing step comprises providing both the safety element 400 and the complementary slot 104 with at least one cross-sectional configuration such as an oval of Cassini, a cross-section in a plane parallel to an axis of a torus, a two-leaved lemniscate of Bernoulli, and a nephroid, wherein the cross-sectional area of the complementary slot 104 approximates that of the intermediate portion 400*b* for facilitating the interference-fit. The at least one fastener 330 providing step and the at least one orifice providing step, together, comprise providing a complementary disposition such as (a) the at least one fastener 330 being disposed at an upper portion 201 of each heel 200 and the at least one orifice 240 being disposed at a heel portion 101 of each upper 100; and (b) the at least one orifice 140 being disposed at a heel portion 101 of each upper 100 and the at least one fastener 330 being disposed at an upper portion 201 of each heel 200.

Figure 6:
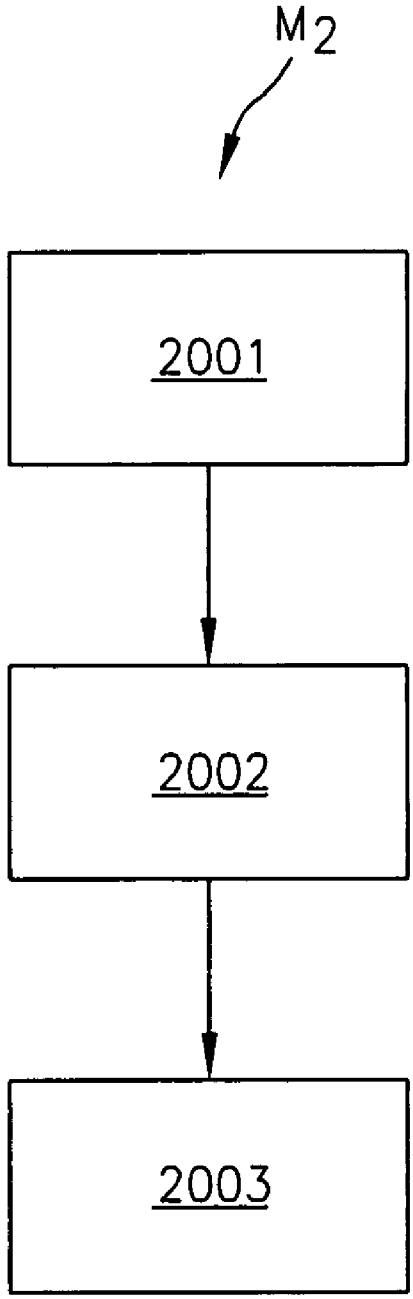
FIG. 6 is a flowchart of a method of varying an appearance of footwear by way of an interchangeable footwear system, in accordance with the present invention.

FIG. 6 illustrates, in a flowchart, a method $M_2$ of varying an appearance of footwear by way of an interchangeable footwear system S, in accordance with the present invention. The present invention method $M_2$ of varying an appearance of footwear by way of a footwear system S generally comprises the steps of (a) providing a footwear system S, as indicated by block 2001, the system S providing step comprising the steps of providing a plurality of interchangeable uppers 100, providing a plurality of interchangeable heels 200, and providing a quick-release device 300 for selectively engaging a heel 200 of the plurality of interchangeable heels 200 with an upper 100 of the plurality of interchangeable uppers 100, (b) selecting a heel 200 from the plurality of interchangeable heels 200, thereby providing a selected heel, and selecting an upper 100 from the plurality of interchangeable uppers 100, thereby providing a selected upper, as indicated by block 2002, and (c) using the quick-release device 300 to selectively interchange the selected heel with the selected upper, thereby varying the appearance of the footwear as indicated by block 2003.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public, regardless of whether the element, component, or method step is explicitly recited in the claims. However, that various changes and modifications in form, material, and fabrication material detail may be made, without departing from the spirit and scope of the inventions as set forth in the appended claims, should be readily apparent to those of ordinary skill in the art as being encompassed by the present invention. No claim herein is to be construed under the provisions of 35 U.S.C. §112, sixth paragraph, unless the element is expressly recited using the phrase "means for."

INDUSTRIAL APPLICABILITY

The present invention industrially applies to footwear systems and methods. More particularly, the present invention industrially applies to footwear systems and methods for providing fashion options. Even more particularly, the present invention industrially applies to footwear systems and methods for providing fashion options via interchangeable components.

What is claimed:

1. An interchangeable footwear system, comprising:

a plurality of interchangeable uppers;

a plurality of interchangeable heels; and a quick-release device comprising a rigid slide reversibly fastenable to the plurality of interchangeable uppers and reversibly fastenable to the plurality of interchangeable heels for selectively engaging a heel of the plurality of interchangeable heels with an upper of the plurality of interchangeable uppers, a rigid guide to mate with the rigid slide, and a safety feature comprising a fastener, at least one complementary orifice for locking together the guide and the slide using the fastener, at least one safety element, and at least one complementary slot for accommodating the at least one safety element, wherein the fastener comprises at least one element selected from a group consisting essentially of a nail, a screw, a thumbscrew, a bolt, a pin, a pair of complementary rivets, and a dowel, wherein the safety element comprises a proximal end, an intermediate portion, and a distal end, the intermediate portion comprising a cross-sectional area being less than those of both the proximal and distal ends, wherein the safety element and the complementary slot respectively comprise at least one cross-sectional configuration selected from a group consisting essentially of an oval of Cassini, a cross-section in a plane parallel to an axis of a torus, a two-leaved lemniscate of Bernoulli, and a nephroid, and wherein the cross-sectional area of the complementary slot approximates that of the intermediate portion for facilitating a resistance-fit between the complementary slot and the intermediate portion.

2. A system, as recited in claim 1, wherein each upper of the plurality of uppers comprises at least one feature selected from a group consisting essentially of a distinct shape, a distinct color, a distinct pattern, a distinct size, and a distinct material.

3. A system, as recited in claim 1, wherein each heel of the plurality of interchangeable heels comprises at least one feature selected from a group consisting essentially of a distinct shape, a distinct color, a distinct pattern, a distinct height, and a distinct material.

4. A system, as recited in claim 1, wherein the guide and the slide, together, comprise a complementary configuration and a complementary disposition selected from a group consisting essentially of:

the guide being disposed at an upper portion of each heel and the slide being disposed at a heel portion of each upper, and the guide being disposed at a heel portion of each upper and the slide being disposed at an upper portion of each heel.

5. A system, as recited in claim 1, wherein the guide and the slide, together, comprise at least one feature selected from a group consisting essentially of:

a complementary inward flange accommodation with an inward flange, respectively; and a complementary outward flange accommodation with an outward flange, respectively.

6. An interchangeable footwear system, comprising:

a plurality of interchangeable uppers;

a plurality of interchangeable heels; and a quick-release device comprising a rigid slide reversibly fastenable to the plurality of interchangeable uppers and reversibly fastenable to the plurality of interchangeable heels for selectively engaging a heel of the plurality of interchangeable heels with an upper of the plurality of interchangeable uppers, a rigid guide to mate with the rigid slide, and a safety feature comprising at least one fastener, at least one complementary orifice for locking together the guide and the slide using the at least one fastener, at least one safety element, and at least one complementary slot for accommodating the at least one safety element, wherein the at least one fastener and the at least one orifice, together, comprise a first complementary disposition selected from a group consisting essentially of: the at least one fastener being disposed at an upper portion of each heel and the at least one orifice being disposed at a heel portion of each upper, and the at least one fastener being disposed at a heel portion of each upper and the at least one orifice being disposed at an upper portion of each heel, and wherein the at least one safety element and the at least one complementary slot, together, comprise a second complementary disposition selected from a group consisting essentially of: the at least one safety element being disposed at an upper portion of each heel and the at least one complementary slot being disposed at a heel portion of each upper, and the at least one safety element being disposed at a heel portion of each upper and the at least one complementary slot being disposed at an upper portion of each heel.

7. An interchangeable footwear system, comprising:

a plurality of interchangeable uppers;

a plurality of interchangeable heels; and a quick-release device comprising a rigid slide reversibly fastenable to the plurality of interchangeable uppers and reversibly fastenable to the plurality of interchangeable heels for selectively engaging a heel of the plurality of interchangeable heels with an upper of the plurality of interchangeable uppers, wherein each upper of the plurality of uppers comprises at least one feature selected from a group consisting essentially of a distinct shape, a distinct color, a distinct pattern, a distinct size, and a distinct material, wherein each heel of the plurality of interchangeable heels comprises at least one feature selected from a group consisting essentially of a distinct shape, a distinct color, a distinct pattern, a distinct height, and a distinct material, wherein the quick-release device comprises a safety feature, wherein the quick-release device further comprises a rigid guide, wherein the guide and the slide, together, comprise a complementary configuration and a first complementary disposition selected from a group consisting essentially of: the guide being disposed at an upper portion of each heel and the slide being disposed at a heel portion of each upper, and the guide being disposed at a heel portion of each upper and the slide being disposed at an upper portion of each heel, wherein the guide and the slide, together, comprise at least one feature selected from a group consisting essentially of: a complementary inward flange accommodation with an inward flange, respectively; and a complementary outward flange accommodation with an outward flange, respectively, wherein the safety feature comprises at least one fastener, at least one complementary orifice for locking together the guide and the slide using the at least one fastener, at least one safety element, and at least one complementary slot for accommodating the at least one safety element, wherein the at least one fastener comprises at least one element selected from a group consisting essentially of a nail, a screw, a thumbscrew, a bolt, a pin, a pair of complementary rivets, and a dowel, wherein the safety element comprises a proximal end, an intermediate portion, and a distal end, the intermediate portion comprising a cross-sectional area being less than those of both the proximal and distal ends, wherein the safety element and the complementary slot respectively comprise at least one cross-sectional configuration selected from a group consisting essentially of an oval of Cassini, a cross-section in a plane parallel to an axis of a torus, a two-leaved lemniscate of Bernoulli, and a nephroid, wherein the cross-sectional area of the complementary slot approximates that of the intermediate portion for facilitating a resistance-fit between the complementary slot and the intermediate portion, wherein the at least one fastener and the at least one orifice, together, comprise a second complementary disposition selected from a group consisting essentially of: the at least one fastener being disposed at an upper portion of each heel and the at least one orifice being disposed at a heel portion of each upper, and the at least one fastener being disposed at a heel portion of each upper and the at least one orifice being disposed at an upper portion of each heel, and wherein the at least one safety element and the at least one complementary slot, together, comprise a third complementary disposition selected from a group consisting essentially of: the at least one safety element being disposed at an upper portion of each heel and the at least one complementary slot being disposed at a heel portion of each upper, and the at least one safety element being disposed at a heel portion of each upper and the at least one complementary slot being disposed at an upper portion of each heel.

8. A method of fabricating an interchangeable footwear system, comprising the steps of:

providing a plurality of interchangeable uppers;

providing a plurality of interchangeable heels; and providing a quick-release device comprising a rigid slide for selectively engaging a heel of the plurality of interchangeable heels with an upper of the plurality of interchangeable uppers, wherein the rigid slide is reversibly attachable to the plurality of interchangeable uppers and the plurality of interchangeable heels, a rigid guide to reversibly mate with the rigid slide, a safety feature comprising at least one fastener, at least one complementary orifice for locking together the guide and the slide by the at least one fastener, at least one safety element, and at least one complementary slot of accommodating the at least one safety element, wherein the at least one fastener comprises at least one element selected from a group consisting essentially of a nail, a screw, a thumbscrew, a bolt, a pin, a pair of complementary rivets, and a dowel, wherein the safety element providing step comprises providing a proximal end, an intermediate portion, and a distal end, the intermediate portion providing step comprising providing a cross-sectional area less than those of both the proximal and distal ends, wherein the safety element providing step and the complementary slot providing step respectively comprise providing at least one cross-sectional configuration selected from a group consisting essentially of an oval of Cassini, a cross-section in a plane parallel to an axis of a torus, a two-leaved lemniscate of Bernoulli, and a nephroid, and wherein the complementary slot providing step comprises providing the cross-sectional area of the complementary slot being approximate to that of the intermediate portion for facilitating a resistance-fit between the complimentary slot and the intermediate portion.

9. A method, as recited in claim 8, wherein the uppers providing step comprises providing each upper of the plurality of uppers with at least one feature selected from a group consisting essentially of a distinct shape, a distinct color, a distinct pattern, a distinct size, and a distinct material.

10. A method, as recited in claim 8, wherein the heels providing step comprises providing each heel of the plurality of interchangeable heels with at least one feature selected from a group consisting essentially of a distinct shape, a distinct color, a distinct pattern, a distinct height, and a distinct material.

11. A method, as recited in claim 8, wherein the guide providing step and the slide providing step, together, comprise providing a complementary configuration and providing a complementary disposition selected from a group consisting essentially of:

the guide being disposed at an upper portion of each heel and the slide being disposed at a heel portion of each upper, and the guide being disposed at a heel portion of each upper and the slide being disposed at an upper portion of each heel.

12. A method, as recited in claim 8, wherein the guide providing step and the slide providing step, together, comprise providing at least one feature selected from a group consisting essentially of:

a complementary inward flange accommodation with an inward flange, respectively, and a complementary outward flange accommodation with an outward flange, respectively.

13. A method, as recited in claim 8, wherein the at least one fastener providing step and the at least one orifice providing step, together, comprise providing a first complementary disposition selected from a group consisting essentially of: the at least one fastener being disposed at an upper portion of each heel and the at least one orifice being disposed at a heel portion of each upper, and the at least one fastener being disposed at a heel portion of each upper and the at least one orifice being disposed at an upper portion of each heel, and wherein the at least one safety element providing step and the at least one complementary slot providing step, together, comprise providing a second complementary disposition selected from a group consisting essentially of: the at least one safety element being disposed at an upper portion of each heel and the at least one complementary slot being disposed at a heel portion of each upper, and the at least one safety element being disposed at a heel portion of each upper and the at least one complementary slot being disposed at an upper portion of each heel.

14. method of fabricating an interchangeable footwear system, comprising the steps of:

providing a plurality of interchangeable uppers;

providing a plurality of interchangeable heels; and providing a quick-release device comprising a rigid slide for selectively engaging a heel of the plurality of interchangeable heels with an upper of the plurality of interchangeable uppers, wherein the rigid slide is reversibly attachable to the plurality of interchangeable uppers and the plurality of interchangeable heels, wherein the uppers providing step comprises providing each upper of the plurality of uppers with at least one feature selected from a group consisting essentially of a distinct shape, a distinct color, a distinct pattern, a distinct size, and a distinct material, wherein the heels providing step comprises providing each heel of the plurality of interchangeable heels with at least one feature selected from a group consisting essentially of a distinct shape, a distinct color, a distinct pattern, a distinct height, and a distinct material, wherein the quick-release device providing step comprises providing a safety feature, wherein the quick-release device providing step further comprises providing a rigid guide to mate with the rigid slide, wherein the guide providing step and the slide providing step, together, comprise providing a complementary configuration and providing a first complementary disposition selected from a group consisting essentially of: the guide being disposed at an upper portion of each heel and the slide being disposed at a heel portion of each upper, and the guide being disposed at a heel portion of each upper and the slide being disposed at an upper portion of each heel, wherein the guide providing step and the slide providing step, together, comprise providing at least one feature selected from a group consisting essentially of: a complementary inward flange accommodation with an inward flange, respectively; and a complementary outward flange accommodation with an outward flange, respectively, wherein the safety feature providing step comprises providing at least one fastener, at least one complementary orifice for locking together the guide and the slide by the at least one fastener, at least one safety element, and at least one complementary slot for accommodating the at least one safety element, wherein the at least one fastener providing step comprises providing at least one element selected from a group consisting essentially of a nail, a screw, a thumbscrew, a bolt, a pin, a pair of complementary rivets, and a dowel, wherein the safety element providing step comprises providing a proximal end, an intermediate portion, and a distal end, the intermediate portion providing step comprising providing a cross-sectional area less than those of both the proximal and distal ends, wherein the safety element providing step and the complementary slot providing step respectively comprise providing at least one cross-sectional configuration selected from a group consisting essentially of an oval of Cassini, a cross-section in a plane parallel to an axis of a torus, a two-leaved lemniscate of Bernoulli, and a nephroid, wherein the complementary slot providing step comprises providing the cross-sectional area of the complementary slot being approximate that of the intermediate portion for facilitating a resistance-fit between the complimentary slot and the intermediate portion, and wherein the at least one fastener providing step and the at least one orifice providing step, together, comprise providing a second complementary disposition selected from a group consisting essentially of: the at least one fastener being disposed at an upper portion of each heel and the at least one orifice being disposed at a heel portion of each upper, and the at least one fastener being disposed at a heel portion of each upper and the at least one orifice being disposed at an upper portion of each heel, and wherein the at least one safety element providing step and the at least one complementary slot providing step, together, comprise providing a third complementary disposition selected from a group consisting essentially of: the at least one safety element being disposed at an upper portion of each heel and the at least one complementary slot being disposed at a heel portion of each upper, and the at least one safety element being disposed at a heel portion of each upper and the at least one complementary slot being disposed at an upper portion of each heel.

* * * * *